US008176859B2

(12) United States Patent
Guo et al.

(10) Patent No.: US 8,176,859 B2
(45) Date of Patent: May 15, 2012

(54) REFRACTORY BRICK AND TAPERED MORTAR JOINT

(75) Inventors: Cliff Yi Guo, Sugar Land, TX (US); Wei Chen, Sugar Land, TX (US); Shashishekara Sitharamarao Talya, Houston, TX (US)

(73) Assignee: General Electric Company, Schenectady, NY (US)

( * ) Notice: Subject to any disclaimer, the term of this patent is extended or adjusted under 35 U.S.C. 154(b) by 725 days.

(21) Appl. No.: 12/357,823

(22) Filed: Jan. 22, 2009

(65) Prior Publication Data

US 2010/0180806 A1 Jul. 22, 2010

(51) Int. Cl.
*F23M 5/00* (2006.01)
*F23M 3/12* (2006.01)

(52) U.S. Cl. ..... 110/336; 110/338; 110/335; 52/747.13; D23/422

(58) Field of Classification Search ..... 110/322, 110/323, 331, 332, 333, 334, 335, 336, 338, 110/339, 340; D23/422; D25/113, 115; 373/71, 72, 73, 75; 52/747.13; 266/283, 266/285, 286
See application file for complete search history.

(56) References Cited

U.S. PATENT DOCUMENTS

| | | | | |
|---|---|---|---|---|
| 1,191,271 | A * | 7/1916 | Bow et al. | 110/335 |
| 4,151,362 | A * | 4/1979 | Hart | 110/335 |
| 4,155,703 | A | 5/1979 | Mantey et al. | |
| 4,453,352 | A | 6/1984 | Allen et al. | |
| 5,316,268 | A * | 5/1994 | Mantey | 266/44 |
| 5,427,360 | A * | 6/1995 | Erny | 266/283 |

* cited by examiner

*Primary Examiner* — Kenneth Rinehart
*Assistant Examiner* — David J Laux
(74) *Attorney, Agent, or Firm* — Cantor Colburn LLP

(57) ABSTRACT

A refractory brick and mortar joint comprise a cold face of the refractory brick; a hot face of the refractory brick opposite the cold face, wherein the hot face is shorter in length than the cold face; and at least one tapered mortar joint extending from the hot face to the cold face, wherein the at least one tapered mortar joint is thicker at the hot face of the refractory brick than at the cold face of the refractory brick. A refractory brick comprises a cold face; a hot face opposite the cold face, wherein the hot face is shorter in length than the cold face; and at least one surface extending from the cold face to the hot face, wherein the at least one surface is angled to accommodate the difference in length between the cold face and the hot face.

6 Claims, 5 Drawing Sheets

REFRACTORY BRICK AND TAPERED MORTAR JOINT

BACKGROUND OF THE INVENTION

The subject matter disclosed herein relates to refractory brick and mortar joint configuration for a gasifier lining.

A gasifier is a type of furnace that is widely used in industry to burn fuel (for example, coal) to produce syngas. Gasification may occur at temperatures ranging from 1300° C. to 1600° C. A gasifier chamber may be lined with refractory bricks, which are designed to be physically and chemically stable at high temperatures. The brick lining is held together by an interlocking mechanism, which may comprise various types of brick designs, such as key or arch shapes. The brick joints allow the bricks to expand. Mortar is applied in the joint to form a continuous lining, preventing gas bypass through the lining. There may be multiple layers of refractory bricks located about the gasifier chamber, so as to fully insulate the gasifier. During operation of the gasifier, the refractory bricks experience thermal expansion. The thermal expansion within the brick and the thermal expansion interference between the adjacent bricks may cause stress in the refractory bricks, thereby damaging the bricks and shortening the lifespan of the gasifier lining.

Accordingly, there remains a need in the art for a refractory brick and mortar joint configuration that will offer a prolonged lifespan for a gasifier lining.

BRIEF DESCRIPTION OF THE INVENTION

According to one aspect of the invention, a refractory brick and mortar joint comprise a cold face of a refractory brick; a hot face of a refractory brick opposite the cold face, wherein the hot face is shorter in length than the cold face; and at least one tapered mortar joint extending from the hot face to the cold face, wherein the at least one tapered mortar joint is thicker at the hot face of the refractory brick than at the cold face of the refractory brick.

According to another aspect of the invention, a method of making a gasifier lining comprises placing a plurality of refractory bricks about a perimeter of a gasifier, each of the plurality of refractory bricks comprising a cold face, and a hot face opposite the cold face, the hot face being shorter in length than the cold face; and interspersing a plurality of tapered mortar joints between the plurality of refractory bricks such that each tapered mortar joint is thicker at the hot face of a refractory brick than at the cold face of a refractory brick.

According to yet another aspect of the invention, a refractory brick comprises a cold face; a hot face opposite the cold face, wherein the hot face is shorter in length than the cold face; and at least one surface extending from the cold face to the hot face, wherein the at least one surface is angled to accommodate the difference in length between the cold face and the hot face.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
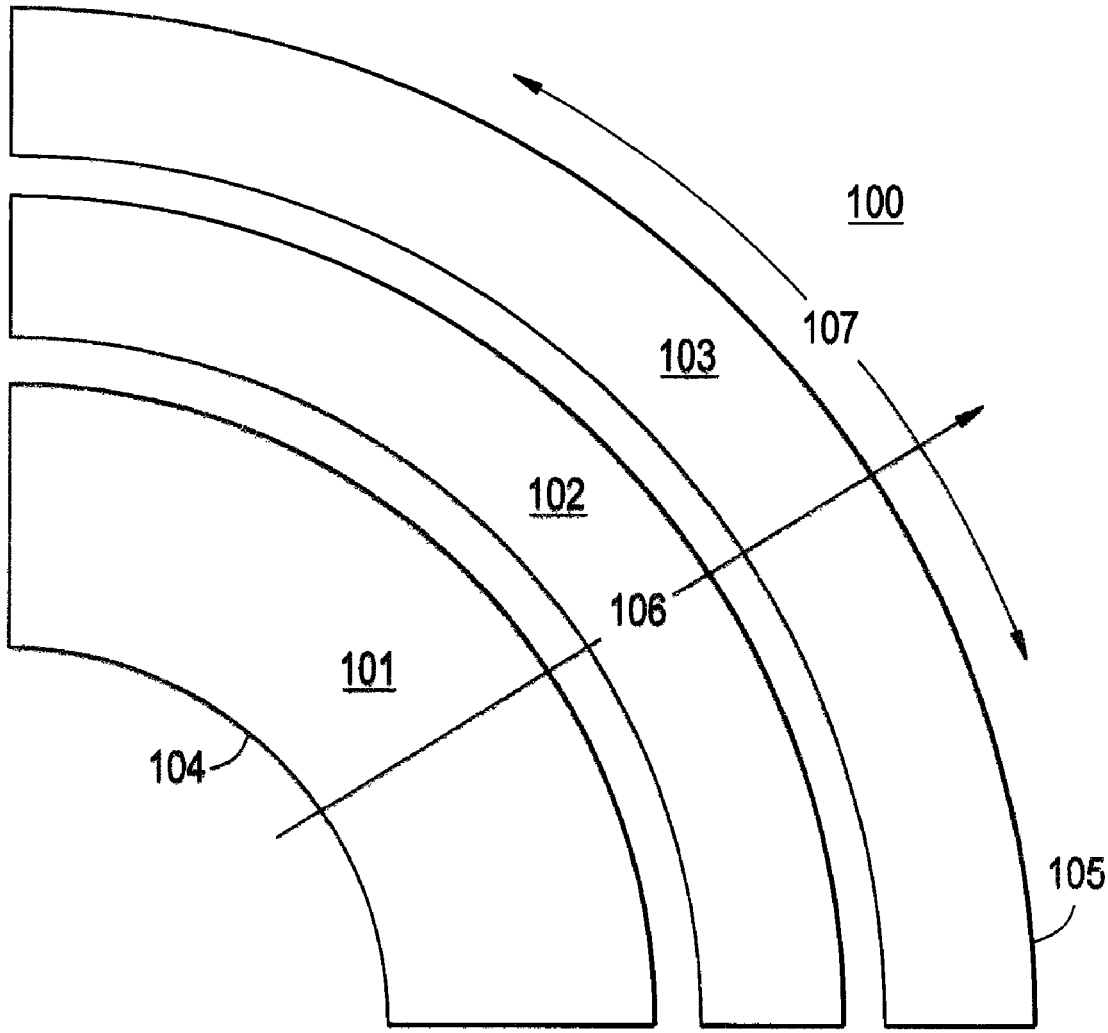
FIG. 1 is a cross-section of an embodiment of a refractory brick lining.

FIG. 1 illustrates a cross section of a refractory brick lining 100. The brick lining may comprise any appropriate number of brick layers; FIG. 1 shows three layers 101, 102 and 103 as an example. Each of brick layers 101, 102, and 103 comprise refractory bricks interspersed with mortar joints, or seams. Surface 104 is the hot, or inside, surface of the lining 100, and surface 105 is the cold, or outside, surface of the lining 100. The individual bricks (not shown) that comprise brick layers 101, 102, and 103 each have a hot face on the side of each brick closest to hot surface 104, and a cold face on the side of each brick closest to cold surface 105. When the gasifier is in operation, the high temperatures cause hot surface 104 to expand more than cold surface 105, causing a differential in heat expansion through brick layers 101, 102, and 103 in hoop, or radial, direction 106. The heat expansion may result in compressive stress in brick layers 101, 102, and 103 along circumferential direction 107. A standard mortar joint may be uniform in width from hot face to cold face, the mortar joint being in line with radial direction 106 of the ring of bricks. The sides of the individual bricks (not shown) may be parallel to the centerline of the mortar joint.

Figure 2:
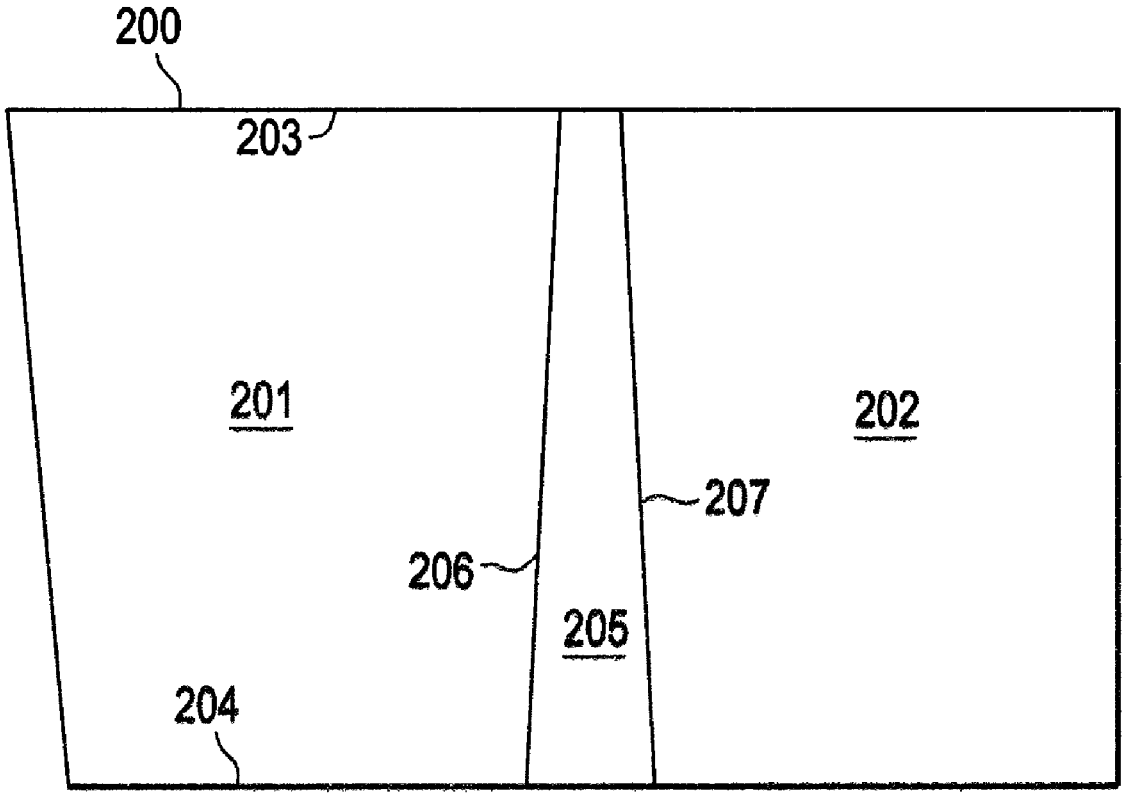
FIG. 2 is an embodiment of a refractory brick and tapered mortar joint configuration.

FIG. 2 illustrates a refractory brick and tapered mortar joint configuration 200. Referring to FIG. 2, brick 201 and brick 202 each comprise a hot face 204 and a cold face 203. The length of the hot face of brick 201 is shorter than the length of the cold face of brick 201, and the length of the hot face of brick 202 is shorter than the length of the cold face of brick 202. Brick 201 and brick 202 are joined by mortar joint 205. The mortar that comprises mortar joint 205 is more compressible than the refractory material that comprises bricks 201 and 202. Mortar joint 205 is tapered, being thicker at hot face 204 than at cold face 203. The taper of mortar joint 205 corresponds to the difference in length of the hot face 204 of brick 202 and the cold face 203 of brick 202. Side 206 of brick 201 and side 207 of brick 202 are angled to accommodate tapered mortar joint 205. The centerline of tapered mortar joint 205 is in line with radial direction 106 (see FIG. 1) of the brick lining. Angled sides 206 and 207 are symmetric with respect to the joint centerline. Each side forms an angle with respect to the centerline which is half the taper angle. The taper angle may be between approximately 0 degrees and approximately 1 degree in some embodiments.

During operation of the gasifier, hot face 204 of bricks 201 and 202 experiences greater thermal expansion than cold face 203 of bricks 201 and 202. The uneven thermal expansion puts compressive stress on mortar joint 205. The compressive stress is absorbed by mortar joint 205 relatively uniformly, due to the taper of mortar joint 205; the thicker portion of mortar joint 205 at hot face 204 absorbs more compression more than the thinner portion at cold face 203. Therefore the compressive stress in hot face 204 of refractory bricks 201 and 202 is reduced. The life of the refractory bricks and the gasifier lining may thereby be extended.

Figure 3:
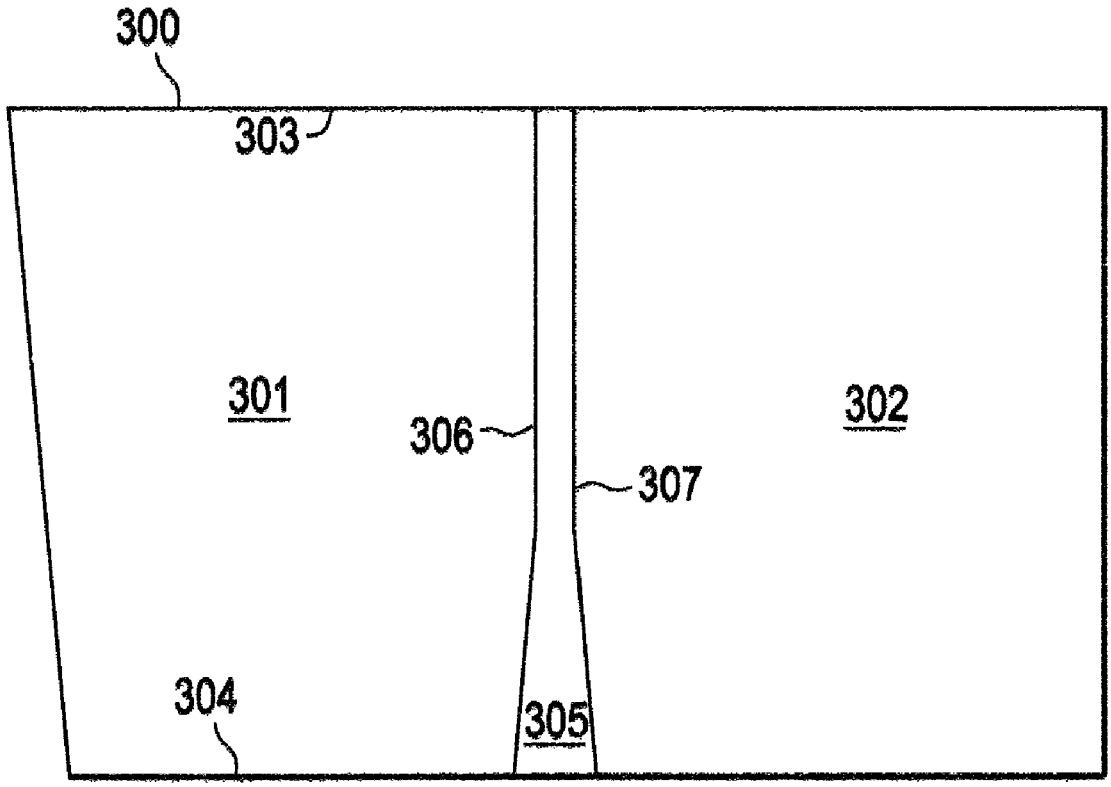
FIG. 3 is an embodiment of a refractory brick and tapered mortar joint configuration.

FIG. 3 shows another embodiment of a tapered mortar joint and refractory brick configuration 300. Tapered joint 305 is uniform in width near the cold face 303, and widens near hot face 304. Side 306 of brick 301 and side 307 of brick 302 are angled to accommodate tapered mortar joint 305. The centerline of tapered mortar joint 305 is in line with radial direction 106 (see FIG. 1) of the brick lining. Angled sides 306 and 307 are symmetric with respect to the joint centerline. Each side forms an angle with respect to the centerline, which is half the taper angle of the tapered portion of mortar joint 305. The taper angle may be between approximately 0 degrees and approximately 5 degrees in some embodiments. In some embodiments, mortar joint 305 may be approximately 1 mm wide at cold face 303, and approximately 4 mm wide at hot face 304.

Figure 4:
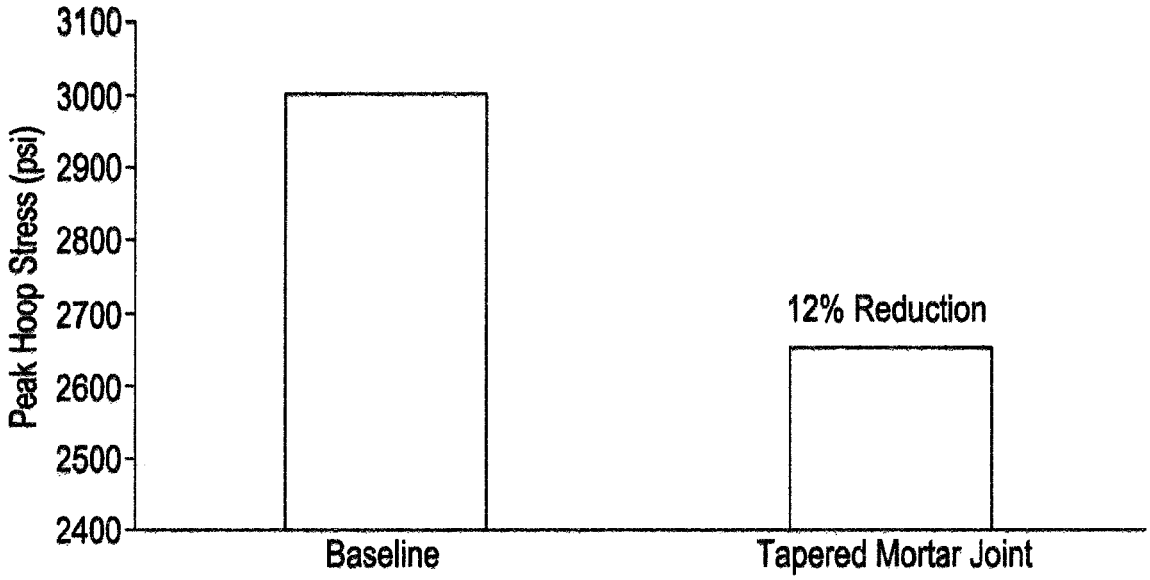
FIG. 4 is a graph of the effect of mortar taper on hoop stress.
Figure 5:
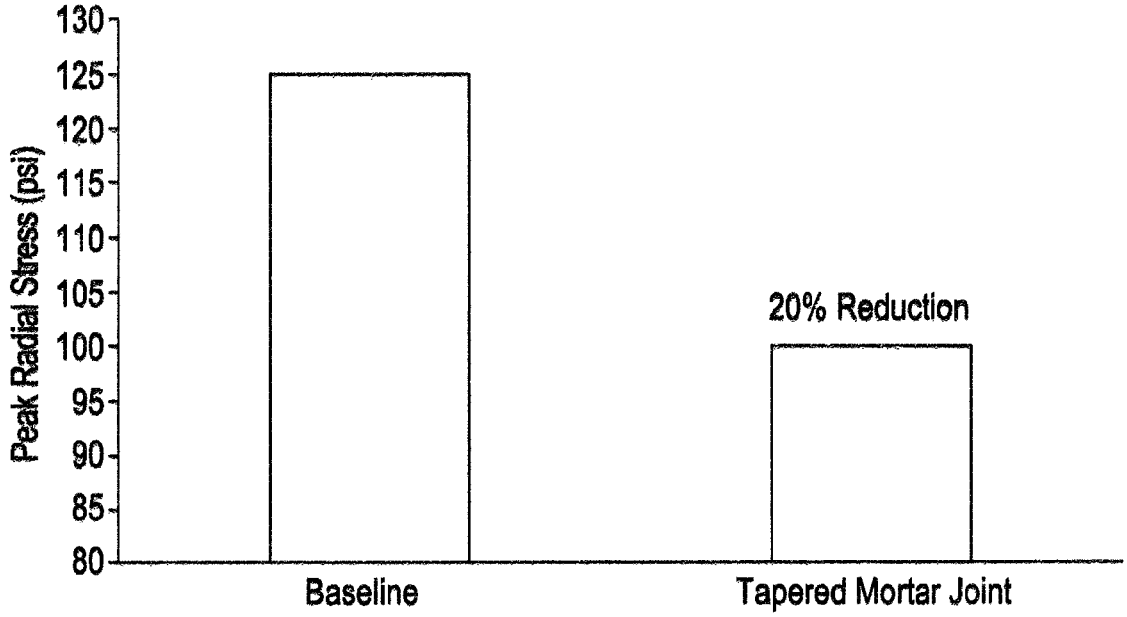
FIG. 5 is a graph of the effect of mortar taper on radial stress.
Figure 6:
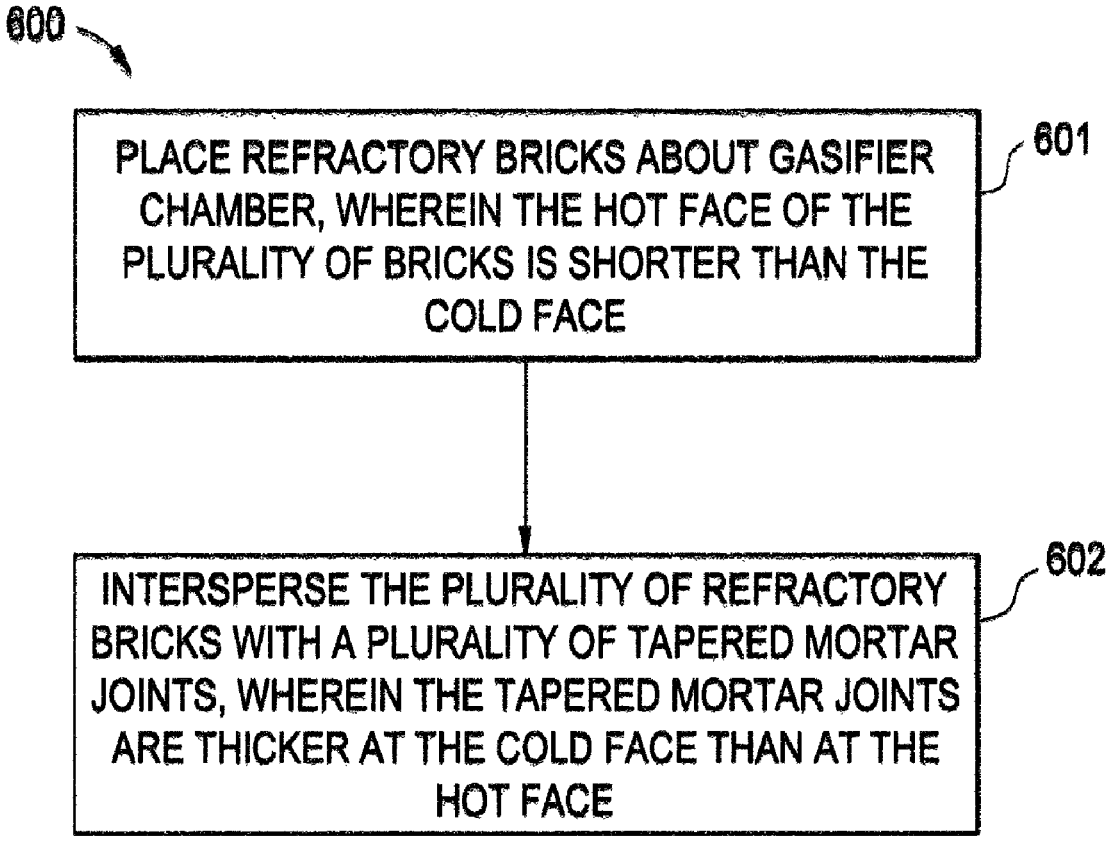
FIG. 6 is an embodiment of a method of producing a refractory brick and tapered mortar joint configuration.

Finite Element Analysis (FEA) of a mortar joint with a uniform thickness versus a tapered mortar joint yields the graphs shown in FIGS. 4-5. FIG. 4 shows the comparison of maximum hoop stress in the refractory brick between uniform thickness (baseline) and tapered mortar joints. The tapered mortar joint used in the analysis is 1.4 mm at hot face and 1.0 mm at cold face. FIG. 5 shows a comparison of maximum radial stress in the refractory brick between baseline and tapered mortar joints. From the data shown in FIGS. 4-5, it is seen that a tapered mortar joint shows significant improvements over a mortar joint having a uniform thickness. There may be a reduction of hoop stress of about 12%, a reduction of radial stress of about 20%, FIG. 6 illustrates an embodiment of a method 600 of producing an optimized brick and mortar joint. In block 601, a plurality of refractory bricks are placed about a perimeter of a gasifier, each of the plurality of refractory bricks comprising a cold face, and a hot face opposite the cold face, the hot face being shorter in length than the cold face. In block 602, the plurality of refractory bricks are interspersed with a plurality of tapered mortar joints between the plurality of refractory bricks, such that each tapered mortar joint is thicker at the hot face of a refractory brick than at the cold face of a refractory brick.

In some embodiments, a tapered mortar joint may average approximately 1.2 mm in thickness from top to bottom; in other embodiments, a tapered mortar joint may range in thickness from approximately 1.0 mm at the cold face to approximately 1.4 mm at the hot face. The mortar joint thickness is dependent on various factors, including the circumference C of the ring of bricks, which is the diameter of the gasifier vessel multiplied by Pi; the number of bricks N used to form the ring, which determines the number of mortar joints; the thickness of the ring x; and the temperature gradient from the hot face to cold face dT/dx. For any given C, N, x, and dT/dx, an optimal hot face mortar joint thickness and cold face mortar joint thickness may be determined for a tapered joint.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A refractory brick and mortar joint, comprising:

a cold face of the refractory brick;

a hot face of the refractory brick opposite the cold face, wherein the hot face is shorter in length than the cold face; and at least one tapered mortar joint extending from the hot face to the cold face, wherein the at least one tapered mortar joint is thicker at the hot face of the refractory brick than at the cold face of the refractory brick, wherein the at least one tapered mortar joint is uniform in thickness near the cold face, and tapered near the hot face.

2. The refractory brick and mortar joint of claim 1, wherein the at least one tapered mortar joint has a taper angle between approximately 0 degrees and approximately 20 degrees.

3. A method of making a lining for a gasifier chamber, comprising:

placing a plurality of refractory bricks about a perimeter of a gasifier, each of the plurality of refractory bricks comprising a cold face, and a hot face opposite the cold face, the hot face being shorter in length than the cold face; and interspersing a plurality of tapered mortar joints between the plurality of refractory bricks such that each tapered mortar joint is thicker at the hot face of a refractory brick than at the cold face of a refractory brick, wherein each tapered mortar joint of the plurality of tapered mortar joints is uniform in thickness near the cold face, and tapered near the hot face.

4. The method of claim 3, wherein each tapered mortar joint of the plurality of tapered mortar joints has a taper angle between approximately 0 degrees and approximately 20 degrees.

5. A refractory brick, comprising:

a cold face;

a hot face opposite the cold face, wherein the hot face is shorter in length than the cold face; and at least one surface extending from the cold face to the hot face, wherein the at least one surface is angled to accommodate the difference in length between the cold face and the hot face, wherein the at least one surface is perpendicular to the cold face, and angled with respect to the hot face.

6. The refractory brick of claim 5, wherein the angle between the at least one surface and the hot face is between approximately 90 degrees and approximately 110 degrees.

* * * * *